United States Patent [19]

Harvey

[11] 4,188,106

[45] Feb. 12, 1980

[54] APPARATUS AND METHOD FOR PROCESSING FILM

[75] Inventor: Donald M. Harvey, Webster, N.Y.

[73] Assignee: Eastman Kodak Company, Rochester, N.Y.

[21] Appl. No.: 949,331

[22] Filed: Oct. 6, 1978

[51] Int. Cl.[2] ..... G03D 3/04

[52] U.S. Cl. ..... 354/330; 354/312; 354/324; 134/44; 134/121

[58] Field of Search ..... 354/312, 315, 323, 324, 354/326, 327, 328, 329, 330, 331, 337; 134/44, 46, 117, 119, 121, 140, 186; 233/3, 23 R, 46; 366/244, 245, 247, 249, 251

[56] References Cited

U.S. PATENT DOCUMENTS

| | | | |
|---|---|---|---|
| 1,962,364 | 6/1934 | Richardson | 354/330 |
| 2,104,283 | 1/1938 | Webster | 354/328 |
| 2,168,846 | 8/1939 | Parker | 354/330 |
| 2,976,792 | 3/1961 | Chambers | 354/328 |
| 4,112,452 | 9/1978 | Patton | 354/330 |
| 4,112,453 | 9/1978 | Hutchison | 354/330 |
| 4,112,454 | 9/1978 | Harvey | 354/330 |
| 4,134,666 | 1/1979 | Kikuchi | 354/329 |

FOREIGN PATENT DOCUMENTS

| | | | |
|---|---|---|---|
| 641582 | 1/1937 | Fed. Rep. of Germany | 354/330 |

*Primary Examiner*—L. T. Hix
*Assistant Examiner*—Alan Mathews
*Attorney, Agent, or Firm*—Roger A. Fields

[57] ABSTRACT

A film disc is rotated in contact with a processing solution in a tray to transform a latent image on the disc to a visible one. The tray, although normally stationary, is supported for rotation about the same axis as that of the rotated disc. After the disc has been processed in the solution, the disc and the tray are operatively connected to simultaneously rotate the two, which centrifugally discharges the solution from the disc and the tray.

9 Claims, 2 Drawing Figures

APPARATUS AND METHOD FOR PROCESSING FILM

BACKGROUND OF THE INVENTION

1. Field of the Invention

The present invention relates generally to an apparatus and a method for fluid-treating photographic film having a disc shaped configuration. More particularly, the invention relates to an apparatus and a method in which a film disc is rotated in a processing solution to transform a latent image on the disc into a visible one.

2. Description of the Prior Art

A variety of devices are known for processing photographic film. Common concerns for processing film in these devices are the desire to minimize or eliminate mechanical contact with the front and back surfaces of the film and the desire to obtain an intimate contact between the film surfaces to be processed and the processing solutions, without any external contaminates or any carryover between different processing solutions. Further desires, from the economic viewpoint, are to provide processing apparatus which is low in cost and simple in operation and to minimize the quantities of processing solution used.

The majority of known processing apparatus has been designed for use with strip film. Two well known general types of processors for strip film are (a) reel processors in which film strips are spirally wound about a reel that is rotated in a processing solution and (b) continuous processors in which film strips spliced end-to-end are fed over a vertically disposed roller rack assembly, first down one side of a tank of processing solution and then up the other side of the tank.

Processors for discrete film units, especially in a disc shaped configuration, are less known, although versions of film discs and cameras that used the discs were first developed some time ago. The scarcity in the prior art of processing apparatus for film discs may indicate that earlier versions of the film discs were, for the most part, processed individually by hand.

More recently, discrete film units having a disc shaped configuration have been developed for use in a modern camera. The film disc and the camera, as well as a cartridge for the film disc, are disclosed in commonly assigned, copending U.S. Pat. Application Ser. No. 931,053, filed Aug. 4, 1978. The film disc has a central aperture about which is concentrically disposed a plastic hub member. The hub member is permanently attached to the disc of photographic film and includes a keyway by which the hub can be secured to a keyed spindle for rotation of the film disc during processing. An example of a processor for the film disc is disclosed in commonly assigned U.S. Pat. No. 4,112,454 patented Sept. 5, 1978. The disclosed processor includes a spindle on which a plurality of film discs may be secured in substantially parallel, hub-to-hub relation. The spindle and the film discs are first rotated in a tank of developing solution and then are withdrawn from the tank and rotated to discharge, by centrifugal force, excess solution that may tend to cling to the spindle and the film discs. Following this, the spindle and the film discs are placed in another tank of processing solution, such as fix or wash, and the steps of spinning the discs in the solution and out of the solution are repeated. After processing in all of the required solutions has been completed, the film discs are spun until dry.

Other examples of film disc processors are disclosed in commonly assigned U.S. Pat. Nos. 4,112,452 and 4,112,453, both patented Sept. 5, 1978 and commonly assigned U.S. Pat. Applications Ser. No. 883,756 and 906,169, filed Mar. 6, 1978 and May 3, 1978 respectively.

SUMMARY OF THE INVENTION

In keeping with the teachings of the present invention, there is provided an improved apparatus and method for processing one or several film discs. According to the method and apparatus, a film disc is placed in a tray of processing solution and rotated to agitate the disc in the solution. The agitation enhances the contact between the image areas of the disc and fresh portions of the solution. After the disc has been processed in the first solution, it is not removed from the tray as in the prior art. Instead, the tray is rotated with the disc about a common axis to centrifugally discharge the first solution from the disc and the tray at the same time. As a result, it is not required as in the prior art to drain the tray of solution, or to spin the film disc removed from the tray, before the film disc is treated with another solution.

According to another feature of the invention, an open tank is disposed beneath the processing tray and contains a liquid ballast in which the tray is partially immersible. The liquid ballast serves to enhance the rotational stability of the tray and to maintain the processing solution in the tray at a substantially uniform temperature.

Still other aspects of the invention and more specific features will become apparent to those skilled in the art from the following description of the preferred embodiment with reference to the accompanying drawings.

DESCRIPTION OF THE PREFERRED EMBODIMENT

Figure 1:
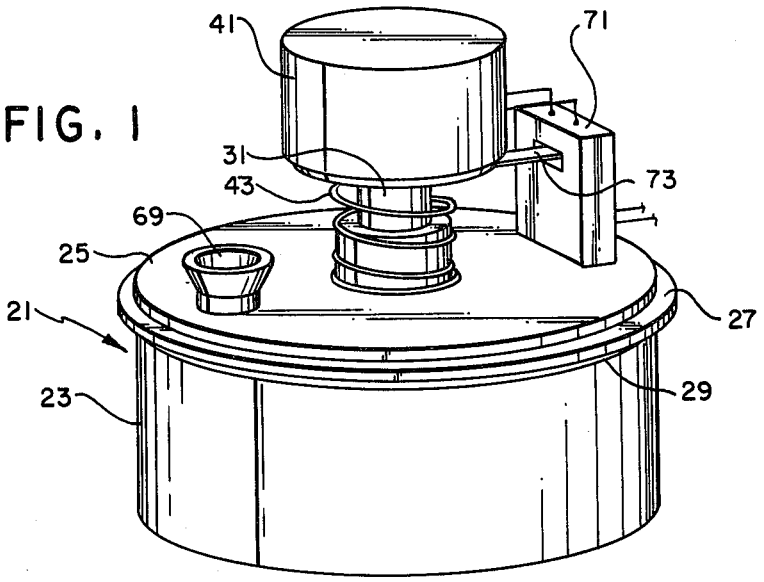
FIG. 1 is a perspective view of a processor in accordance with the present invention.

Referring now to the drawings, apparatus is depicted in accordance with a preferred embodiment of the present invention for processing discrete film units to establish from latent images, visually perceivable images, such as for direct viewing, projection or printing.

Figure 2:
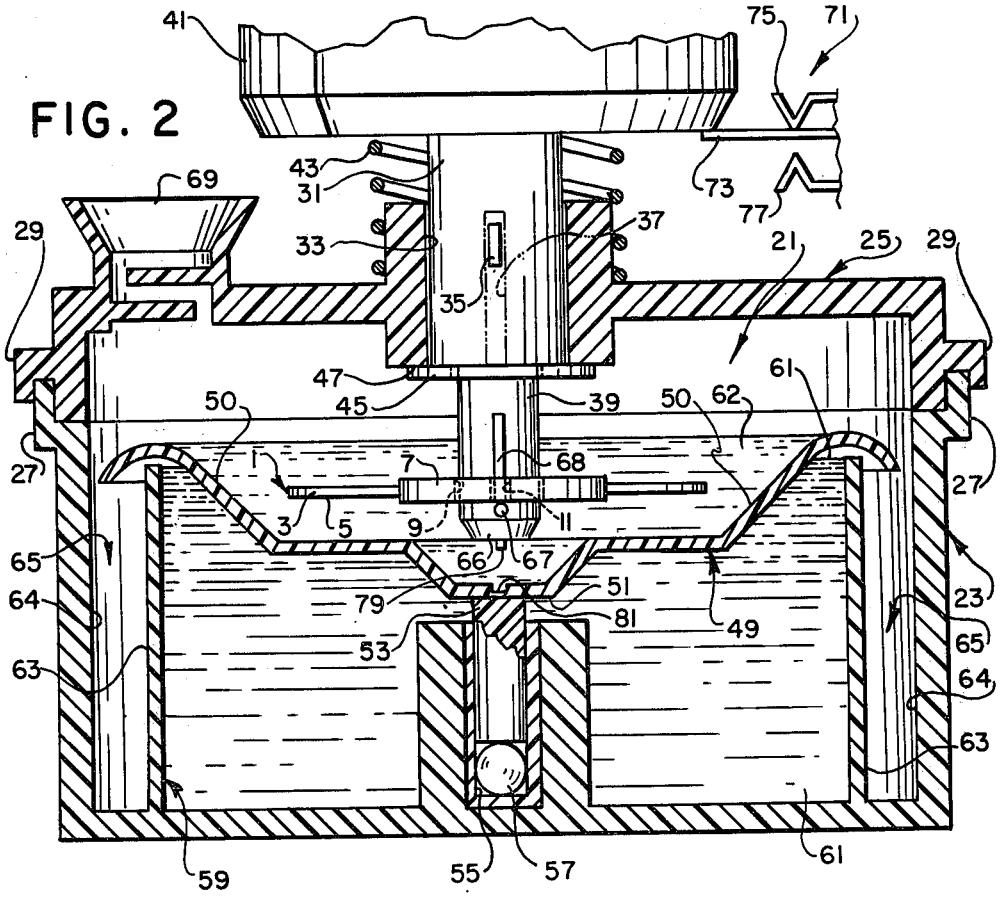
FIG. 2 is an elevational view of the processor, substantially shown in section.

The apparatus has particular utility and will be described with disc shaped film units having a centrally located aperture. Such a configuration is illustrated and described more fully in commonly assigned, copending U.S. Pat. Application Ser. No. 931,053, entitled PHOTOGRAPHIC FILM CARTRIDGE ASSEMBLY AND CAMERA, filed on Aug. 4, 1978 in the name of G. S. Sethi, the disclosure of which is incorporated into the present application by reference. As there described and as shown in FIG. 2 of the drawings in the present application, the film disc 1 includes a flexible but relatively stiff support disc 3 coated on one of its face surfaces with a photosensitive emulsion, defining a dimensionally-stable and self-supporting annular imaging area 5. The support disc 3 is fixed to a rigid hub or core 7 which is somewhat thicker than the support disc and defines a central aperture 9 having a keyway 11. For purposes of describing the processing apparatus, it will be observed that the film disc 1 is generally flat or planar and that the central aperture 9 defines an axis of rotation substantially normal to the plane of the annular imaging area 5.

As depicted in FIGS. 1 and 2, the processing apparatus is illustrated in the form of a light-tight, generally cylindrical housing or container 21 which comprises a main tank 23 and a removable cover 25. The tank 23 and the cover 25 may be connected at respective complementarily shaped annular lips 27 and 29 to prevent ambient light from entering the housing 21. A sleeve 31, which is longitudinally movable in a bore 33 in the cover 25, includes a key 35 that is similarly movable in a keyway 37 in the bore. A spindle 39, which is freely rotatable within the sleeve 31, is connected to a two-speed electric drive motor 41 for rotating the spindle. When the spindle 39 is rotated by the drive motor 41, the engagement of the key 35 with the keyway 37 prevents the sleeve 31 from rotating. The drive motor 41 is spaced from the cover 25 by a helical compression spring 43. A ring-like stop 45, through which the spindle 39 extends, is secured to the sleeve 31 and usually abuts against an underside 47 of the cover 25 to limit the effect of the spring 43. For purposes to become apparent in the description of operation below, the drive motor 41 may be depressed against the force of the spring 43 to slightly lower the sleeve 31 and the spindle 39, which will space the stop 45 from the underside 47 of the cover 25.

Referring again to FIG. 2, the spindle 39 depends into a shallow, circular processing tray 49 which has a radially inclining side 50. The processing tray 49 is supported at a center portion 51, by a post 53 in a bearing 55, for rotation about the same axis as that of the spindle 39. The post 53 rests on a support ball 57 in the bearing 55 to enhance the free-turning ability of the processing tray 49. An open tank 59 is disposed beneath the processing tank 49. The open tank 59 contains a heated liquid ballast 61, such as water, in which the processing tray 49 is partially immersed to enhance its rotational stability and to maintain a processing solution 62 in the processing tray at a substantially uniform temperature. The open tank 59 and the main tank 23 are separated at respective annular side walls 63 and 64 to define an overflow sump 65 therebetween. The sump 65 serves to receive any liquid ballast 61 which may overflow from the open tank 59 and to receive any processing solution 62 which may overflow from the processing tray 49.

In operation, a free-end portion 66 of the spindle 39 is inserted through the central aperture 9 in the film disc 1. One or several spring-urged depressible stops 67, which project from the spindle 39, prevent the film disc 1 from falling off the spindle. A key 68 of the spindle, which is received in the keyway 11 of the film disc, secures the film disk to the spindle for coaxial synchronous rotation. As recognized from FIG. 2, this rotation is about an axis substantially normal to the plane of the imaging area 5 of the film disc 1.

After the film disc 1 is secured to the spindle 39, the operator places the cover 25 on the main tank 23 and pours the processing solution 62, through a light-locked funnel 69 in the cover, and into the processing tray 49. The drive motor 41 is energized to rotate the film disc 1 and the spindle 39, in contact with the processing solution 62 in the tray 49. The tray 49 generally remains stationary and the resulting agitation of the film disc 1 in the processing solution 62 enhances the contact between the two. After the prescribed time has elapsed for transforming the latent images on the film disc 1 to visibly perceivable ones, the operator depresses the energized motor 41, which lowers the rotating disc 1 and spindle 39 against the upward urging of the spring 43. A double pole switch 71 having a switch element 73 secured to the energized motor 41 is moved by the depressed motor from contact with a switch pole 75 to contact with a switch pole 77. Movement of the switch 71, which is disposed in a conventional motor speed control circuit, not shown, changes the speed of the motor 41 from a relatively slow one, such as 300 r.p.m., to a relatively fast one, such as 3,000 r.p.m. However, immediately before the motor speed is increased a locking member 79, which depends from the free-end portion 66 of the spindle 39, is received in a locking recess 81 in the center portion 51 of the processing tray 49. This connects the rotating spindle and the stationary tray to cause the stationary tray to be rotated about the same axis as that of the film disc and the spindle. As a result, the first solution 62 is centrifugally discharged from the tray 49, the film disc 1 and the spindle 39, and into the overflow sump 65. Once the first solution is removed from the tray, the film disc and the spindle, the operator releases the energized motor 41, which allows the spring 43 to raise the free-end portion 66 of the rotating spindle from the center portion 51 of the tray. This breaks the driving connection between the rotating spindle and the empty tray, which then comes to rest. Raising the energized motor 41 further serves to move the switch element 73 from contact with the high speed pole 77 to contact with the low speed pole 75, returning the motor speed to 300 r.p.m.

Following this, the operator may pour another processing solution through the light-locked funnel 69 into the stationary tray 49. Of course, should it be desired, the drive motor can be de-energized before introducing a new batch of processing solution into the stationary tray. Once the stationary tray receives the new batch of processing solution, the steps of rotating the film disc at a low speed in the processing solution and of rotating the film disc along with the tray at a high speed to centrifugally discharge the processing solution, are repeated. After treatment of the film disc in all of the required solutions has been completed, the film disc may be rotated with the tray at the high speed until both are dry.

Although the invention has been described in detail with particular reference to a preferred embodiment, it will be readily understood that variations and modifications can be effected within the spirit and scope of the invention. For example, although the processing apparatus has been illustrated for use with only one film disc, it will be appreciated that several film discs can be placed on the spindle 39 in substantially parallel, hub-to-hub relation for simultaneous processing. Moreover, rather than employing the free-end portion 66 of the rotating spindle to rotate the processing tray 49, the hub 7 of the film disc can be used for the same purpose.

I claim:

1. Apparatus for processing a film disc, said apparatus comprising:

a tray for receiving a film disc and a processing solution;

means for rotating a film disc with respect to said tray, the film disc being in contact with a processing solution in said tray;

means supporting said tray for rotation about the same axis as that of a rotated disc; and means for selectively coupling said tray and said rotating means for simultaneously rotating said tray and a film disc to centrifugally dishcarge the processing solution from said tray and the film disc after the disc has been processed in the solution.

2. Apparatus for processing a film disc, said apparatus comprising:

a substantially shallow, circular tray for receiving a film disc and a processing solution;

means for rotating a film disc with respect to said tray, the film disc being immersed in a processing solution in said tray;

means supporting said tray for rotation about the same axis as that of a rotated disc;

means for selectively coupling said tray and said rotating means for simultaneously rotating said tray and a film disc to centrifugally discharge the processing solution from said tray and the film disc after the disc has been processed in the solution; and means defining an overflow sump disposed about said tray for receiving the processing solution centrifugally discharged from said tray and a film disc.

3. Apparatus for processing a film disc having a central aperture, said apparatus comprising:

rotatable spindle means receivable in the central aperture of a film disc for supporting the disc for rotation with said spindle means;

a circular tray for receiving a film disc and a processing solution;

drive means for rotating said spindle means and a film disc with respect to said tray, the film disc being in contact with a processing solution in said tray;

means supporting said tray for rotation about the same axis as that of said spindle means; and means for selectively coupling said spindle means and said tray for simultaneously rotating said spindle means with a film disc and said tray about the same axis to centrifugally discharge the processing solution from said tray and the film disc after the disc has been processed in the solution.

4. Apparatus as recited in claim 3, wherein said selectively coupling means includes means for axially moving said spindle means into rotation-including contact with said tray, and means coupled to said drive means for changing the speed of rotation of said spindle means in response to its movement into rotation-inducing contact with said tray.

5. Apparatus as recited in claim 3, wherein said tray has a center portion which is rotatably supported by said tray supporting means, and wherein said selectively coupling means connects said spindle means and said portion of said tray.

6. Apparatus for processing a film disc, said apparatus comprising:

a substantially shallow, circular tray for receiving a film disc and a processing solution;

means for rotating a film disc with respect to said tray, the film disc being in contact with a processing solution in said tray;

means supporting said tray for rotation about the same axis as that of a rotated disc;

an open tank disposed beneath said tray for containing a liquid ballast in which said tray is partially immersible to enhance its rotational stability and to maintain the processing solution in said tray at a substantially uniform temperature; and means for selectively coupling said tray and said rotating means for simultaneously rotating said tray and a film disc to centrifugally discharge the processing solution from said tray and the film disc after the disc has been processed in the solution.

7. Apparatus for processing a film disc having a central aperture, said apparatus comprising:

rotatable spindle means receivable in the central aperture of a film disc for supporting the disc for rotation with said spindle means;

a substantially shallow, circular tray for receiving a film disc and a processing solution;

drive means for rotating said spindle means and a film disc with respect to said tray, the film disc being in contact with a processing solution in said tray;

means supporting said tray at a center portion for rotation about the same axis as that of said spring means;

an open tank disposed beneath said tray for containing a liquid ballast in which said tray is partially immersible to enhance its rotational stability and to maintain the processing solution in said tray at a substantially uniform temperature;

means for selectively coupling said center portion of said tray and said spindle means for simultaneously rotating said spindle means with a film disc and said tray about the same axis to centrifugally discharge the processing solution from said tray and the film disc after the disc has been processed in the solution; and means defining an overflow sump disposed about said tank and said tray respectively for receiving any liquid ballast which flows over the sides of said tank and for receiving the processing solution centrifugally discharged from said tray and a film disc.

8. A method of processing a film disc, said method comprising the successive steps of:

placing the film disc in a tray containing a processing solution;

rotating the film disc with respect to said tray, the film disc being in contact with the processing solution to agitate the disc in the solution and enhance the contact therebetween; and simultaneously rotating the film disc and the tray about a common axis to centrifugally discharge the processing solution from the film disc and the tray only after the disc has been processed in the solution.

9. A method as recited in claim 8, wherein the film disc and the tray are simultaneously rotated by selectively coupling the tray and means for rotating the film disc in the processing solution.

* * * * *

UNITED STATES PATENT OFFICE
CERTIFICATE OF CORRECTION

PATENT NO. : 4,188,106

DATED : February 12, 1980

INVENTOR(S) : Donald Malcolm Harvey

It is certified that error appears in the above-identified patent and that said Letters Patent are hereby corrected as shown below:

| | |
|---|---|
| Col. 5, line 44 | Delete "including" and insert --inducing--. |
| Col. 5, line 53 | Insert the word --center-- before the word "portion". |

Signed and Sealed this

*Tenth* Day of *June 1980*

[SEAL]

*Attest:*

*Attesting Officer*

SIDNEY A. DIAMOND

*Commissioner of Patents and Trademarks*